United States Patent [19]

Yamada et al.

[11] Patent Number: 5,015,813

[45] Date of Patent: May 14, 1991

[54] POWER FEEDING PORT ARRANGEMENT FOR A MICROWAVE HEATING APPARATUS

[75] Inventors: Katsuyoshi Yamada; Tsutomu Arai, both of Hanazono, Japan

[73] Assignees: Mitsubishi Denki Kabushiki Kaisha, Tokyo; Mitsubishi Electric Home Appliance Co., Ltd., Saitama, both of Japan

[21] Appl. No.: 450,250

[22] Filed: Dec. 13, 1989

[30] Foreign Application Priority Data

Dec. 14, 1988 [JP] Japan ..... 63-313675
May 17, 1989 [JP] Japan ..... 1-123174

[51] Int. Cl.[5] ..... H05B 6/72
[52] U.S. Cl. ..... 219/10.55 F; 219/10.55 E
[58] Field of Search ..... 219/10.55 F, 10.55 A, 219/10.55 E, 10.55 R

[56] References Cited

U.S. PATENT DOCUMENTS

| | | | |
|---|---|---|---|
| 3,210,511 | 10/1965 | Smith | 219/10.55 F |
| 3,373,259 | 3/1968 | Smith | 219/10.55 F |
| 3,402,277 | 9/1968 | Muller | 219/10.55 F |
| 4,121,078 | 10/1978 | Takano et al. | 219/10.55 F |
| 4,456,806 | 6/1984 | Arimatsu | 219/10.55 F |
| 4,733,037 | 3/1988 | Nitta et al. | 219/10.55 F |

FOREIGN PATENT DOCUMENTS

| | | | |
|---|---|---|---|
| 52-10937 | 1/1977 | Japan | 219/10.55 F |
| 53-2742 | 1/1978 | Japan | 219/10.55 F |
| 60-30077 | 7/1985 | Japan . | |
| 60-35988 | 10/1985 | Japan . | |
| 60-35991 | 10/1985 | Japan . | |
| 61-11916 | 4/1986 | Japan . | |
| 61-15589 | 5/1986 | Japan . | |
| 62-22080 | 6/1987 | Japan . | |
| 62-30798 | 8/1987 | Japan . | |
| 62-31999 | 8/1987 | Japan . | |
| 62-37504 | 8/1987 | Japan . | |

*Primary Examiner*—Philip H. Leung
*Attorney, Agent, or Firm*—Oblon, Spivak, McClelland, Maier & Neustadt

[57] ABSTRACT

A microwave heating apparatus is provided with a waveguide, a heating chamber and a plurality of power feeding ports for communicating the waveguide and the heating chamber, and is adapted to oscillate radio waves so as to uniformly heat a material to be heated in the heating chamber by arranging a microwave oscillating antenna along the surface of the waveguide facing the segment between the plurality of power feeding ports, or by arranging a microwave oscillating antenna along the surface of the waveguide facing the portion between the power feeding ports.

10 Claims, 19 Drawing Sheets

*FIG. 11*

| POWER FEEDING METHOD | | A (15, 35, M) | B (25, 25, M) | C (40, 18.6, M) |
|---|---|---|---|---|
| OUTPUT (W) | 2 liter (OUT-PUT/INPUT %) | 505W(48.3%) | 525W(50%) | 515W(49.6%) |
| | 1 liter | 460 | 481 | 460 |
| | 0.5 liter | 418 | 425 | 411 |
| | 0.275 liter | 368 | 391 | 368 |
| | 0.1 liter | 260 | 271 | 268 |
| 15 FROZEN "SHAO MAIS" INITIAL TEMP.-20°C HEATING TIME 5min | AV. TEMP. | 97.9°C | 92.7°C | 87.4°C |
| | MAX. TEMP. | 100.5°C | 100.5°C | 99°C |
| | MIN. TEMP. | 90.9°C | 75.8°C | 53°C |
| | MAX. - MIN. | 9.6°C | 24.7°C | 46°C |
| 8 FROZEN MEATBALLS INITIAL TEMP.-20°C HEATING TIME 6min | AV. TEMP. | 84.6°C | 78.4°C | 64.5°C |
| | MAX. TEMP. | 101.4°C | 98.5°C | 91°C |
| | MIN. TEMP. | 72.3°C | 57°C | 33°C |
| | MAX. - MIN. | 29.1°C | 41.5°C | 58°C |
| MILK: 200cc HEATING TIME 2min | TEMP. RISE | 54.5°C | 51.2°C | 55.1°C |
| | MAX. TEMP. (UPPER) | 67.8°C | 66.9°C | 73.4°C |
| | MIN. TEMP. (LOWER) | 62.9°C | 61.5°C | 64.3°C |
| | MAX. - MIN. | 4.9°C | 5.4°C | 9.1°C |
| SAKE (JAPANESE WINE): 180cc HEATING TIME 1min30sec | TEMP. RISE | 39°C | 40°C | 39.7°C |
| | MAX. TEMP. (UPPER) | 59.5°C | 58.9°C | 62°C |
| | MIN. TEMP. (LOWER) | 53.6°C | 52.8°C | 55°C |
| | MAX. - MIN. | 5.9°C | 6.1°C | 7°C |

*FIG. 12*

| POWER FEEDING METHOD | | A (15, 35, M) | B (25, 25, M) | C (40, 18.6, M) |
|---|---|---|---|---|
| OUTPUT (W) | 2 liter (OUTPUT/INPUT %) | 505W(48.3%) | 525W(50%) | 515W(49.6%) |
| | 1 liter | 460 | 481 | 460 |
| | 0.5 liter | 418 | 425 | 411 |
| | 0.275 liter | 368 | 391 | 368 |
| | 0.1 liter | 260 | 271 | 268 |
| CORN POTAGE SOUP: 200cc HEATING TIME 3min | TEMP. RISE | 63.1°C | 58.8°C | 46°C |
| | MAX. TEMP. | 97°C | 98°C | 68°C |
| | MIN. TEMP. | 80°C | 71.3°C | 46°C |
| | MAX. − MIN. | 17°C | 26.7°C | 22°C |
| CURRY (RETORT) 338g HEATING TIME 4min | TEMP. RISE | 59.5°C | 50°C | 55°C |
| | MAX. TEMP. | 94.6°C | 92.8°C | 83°C |
| | MIN. TEMP. | 86.5°C | 78.5°C | 60°C |
| | MAX. − MIN. | 18.1°C | 14.3°C | 23°C |
| COOL COOKED RICE: 150g INITIAL TEMP. 8°C HEATING TIME 1min10sec HEATED W/RICE BOWL | MAX. TEMP. | 96.8°C | 96.8°C | 73.4°C |
| | MIN. TEMP. | 71.2°C | 71.4°C | 64.3°C |
| | MAX. − MIN. | 25.6°C | 25.4°C | 9.1°C |
| COOL COOKED GRATIN: 250g INITIAL TEMP. 20°C HEATING TIME 3min | MAX. TEMP. | 99.9°C | 97.3°C | 84°C |
| | MIN. TEMP. | 93.9°C | 92.3°C | 69°C |
| | MAX. − MIN. | 6°C | 5°C | 15°C |

POWER FEEDING PORT ARRANGEMENT FOR A MICROWAVE HEATING APPARATUS

BACKGROUND OF THE INVENTION

The present invention relates to a microwave heating apparatus such as an electronic oven. More particularly, it relates to an improvement in the shape of a waveguide having a plurality of power feeding ports.

There have been proposed microwave heating apparatuses with a waveguide in which a single power feeding port is formed. FIGS. 31 and 32 are respectively longitudinal cross-sectional views in schematic forms of an electronic oven which utilizes a conventional microwave heating apparatus. Description will be made with reference to FIGS. 31 and 32. A reference numeral 1 designates a heating chamber, a numeral 2 designates a turn table positioned at the lower portion of the heating chamber 1 and adapted to receive thereon a material to be heated 6, a numeral 3 designates a magnetron for generating microwaves, a numeral 7 designates an antenna for emitting the microwaves, and a numeral 4 designates a waveguide which is attached to the outer wall of the ceiling of the heating chamber 1 and guides the microwaves emitted from the magnetron 3 to a power feeding port 5 formed in the ceiling of the heating chamber 1.

The conventional electronic oven as shown in FIG. 31 is so adapted that the material to be heated 6 (hereinbelow, referred to as a heating material) is placed on the turn table 2, and when a door is closed to actuate a power switch (not shown), the turn table 2 is started to rotate, and at the same time, microwaves are emitted from the antenna 7 of the magnetron 3. The microwaves are supplied to the heating chamber 1 via the waveguide 4 and the power feeding port 5 to thereby heat the heating material 6.

FIG. 32 shows another conventional technique, wherein a power feeding port 5 is formed at the upper portion of a side wall of the heating chamber 1. Microwaves are supplied into the heating chamber 1 through the power feeding port 5. A waveguide 4 attached to the outer surface of the side wall of the heating chamber 1. The function of the apparatus as shown in FIG. 32 is the same as that in FIG. 31.

In the conventional microwave heating apparatuses, since only one power feeding port 5 for supplying the microwaves into the heating chamber 1 is formed in the ceiling or a side wall, the microwaves can not be supplied uniformly to the heating material 6 as shown in FIGS. 31 and 32 to thereby often cause uneven heating to the heating material. Further, it takes much time to heat the heating material 6 depending on the position of the heating material, and much power is consumed.

To eliminate the above-mentioned problems, microwave heating apparatuses having a plurality of power feeding ports formed in a waveguide are proposed as shown in FIGS. 33 and 34. FIG. 33 is a longitudinal crosssectional view of a conventional microwave heating apparatus having power feeding ports formed in the ceiling of the heating chamber, which is described in, for instance, Japanese Examined Utility Model Publication 15589/1986. FIG. 34 is a longitudinal cross-sectional view of a conventional microwave heating apparatus having power feeding ports in a side surface of the heating chamber. In FIG. 33, a numeral 1 designates a heating chamber, a numeral 8 designates a waveguide attached to the top surface of the heating chamber 1 so that an end of the waveguide projects from the right side portion of the top surface, a numeral 9 designates three power feeding ports formed in the top surface of the heating chamber 1 so as to communicate the waveguide 8 with the heating chamber 1, a numeral 3 designates a magnetron as a microwave oscillating apparatus which is connected to the lower end of the projecting portion of the waveguide 8 and has an antenna 7 extending in the waveguide 8. In FIG. 34, a waveguide 10 is provided at a side surface of the heating chamber 1, and two power feeding ports are formed at the side surface of the heating chamber 1 so as to communicate the waveguide 10 with the heating chamber 1.

Let's assume that a wavelength of radiowaves oscillated from the antenna 7 is $\lambda g$. The distance from the center of the antenna 7 to the surface of the waveguide 8 facing oppositely the surface where the power feeding ports are formed is called a back plunger which has a wavelength of $\lambda g/4$, and it is usually determined to be 18.6 mm–22 mm.

With respect to the backup plunger, it is introduced in, for instance, a publication "A lecture of practical microwave, a microwave circuit", p.148–149 by Mrs. Kunihiro Suetake and Shuichi Hayashi published by Ohm Sha on Oct. 31, 1958, as follows. "Normally, a short circuit plate S is provided at a position apart from a length of about $\frac{1}{4}$ from an antenna to cause a short circuit as shown in Figures (FIGS. 35 and 36). Thus, there is obtainable radiowaves propagating in the opposite direction".

The microwave heating apparatus having more than two power feeding ports with the back plunger is disclosed in addition to the above-mentioned conventional apparatus, in publications such as Japanese Examined Patent Publication 37504/1987, Japanese Examined Patent Publication 30077/1985, Japanese Examined Utility Model Publication 22080/1987, Japanese Examined Utility Model Publication 31999/1987, Japanese Examined Utility Model Publication 30798/1987, Japanese Examined Utility Model Publication 11916/1986, Japanese Examined Utility Model Publication 35988/1985, Japanese Examined Utility Model Publication 35991/1985 and so on.

In operations, microwaves oscillated from the antenna 7 of the magnetron 3 are propagated toward the heating chamber 1 by the back plunger provided in the waveguide 8 or 10 and are introduced into the heating chamber 1 through the power feeding ports 6, whereby a material to be cooked placed in the heating chamber 1 is heated.

In the conventional microwave heating apparatus having the above-mentioned construction, the shape of the waveguide 8 or 10 was inevitably complicated by satisfying both requirements that the back plunger has to be provided and a plurality of power feeding ports 9 or 11 have to be provided at desired positions. Namely, in a case that the power feeding ports 9 are formed at the central portion of the top surface of the heating chamber 1 and both end portions with respect to the central portion in order to reduce uneven heating as shown in FIG. 33, the back plunger is assured by projecting an end of the waveguide 8 from an end of the heating chamber, by connecting the magnetron 3 at the lower portion of the projecting part, and by inserting the antenna 7.

In a case that the power feeding ports are formed at the upper and lower portions of a side surface of the heating chamber 1 as shown in FIG. 34, the back plunger is assured by projecting the central portion of the waveguide 10 in the lateral direction, by connecting the magnetron 3 to the lower portion of the projecting part, and by inserting the antenna 7. In either case of the waveguides 8, 9 as shown in FIGS. 33 and 34, the magnetron 3 and its connecting portion were unevenly projected with respect to the heating chamber 1. Accordingly, there arose problems that the structure of the waveguide 8 or 10 was complicated, the number of machining steps was increased, hence, the manufacturing cost became high, a freedom in determining the position of structural elements was limited, and the size of a microwave heating apparatus main body became large.

Definitions of the uneven projection and the even projection will be described. In a case of a waveguide 8 projecting from the top surface of a microwave heating apparatus main body as shown in FIG. 37, a projecting portion is called an uneven projection 12. On the other hand, in a case of a waveguide 8 whose projecting portion 13 extend on and along another surface as shown in FIG. 38, a projecting portion is called uneven projection 13. There is proposed another technique as shown in FIG. 39 that a waveguide 8 is attached to the top surface of the heating chamber so as to extend from an end to the other end, but so as not to project from the heating chamber 1, power feeding ports 14 are formed at the central portion and an end portion so as to communicate the waveguide 8 with the heating chamber 1, and an antenna 7 for a magnetron 3 is arranged at a position apart from the end of the waveguide 8 by a wavelength of $\lambda g/4$. In this technique, however, the length of the waveguide 8 is inevitably large and it is impossible to form the power feeding ports at both end portions. Further, it is difficult to reduce uneven heating because the plural power feeding ports are formed.

SUMMARY OF THE INVENTION

It is an object of the present invention to eliminate the above-mentioned problems and to provide a microwave heating apparatus having a waveguide of a simple structure and capable of reducing uneven heating to a material to be cooked.

In accordance with the present invention, there is provided a microwave heating apparatus which comprises a microwave heating apparatus main body, a heating chamber provided in the microwave heating apparatus main body, a waveguide member for providing a waveguide projecting substantially uniformly along a wall of the heating, chamber, a plurality of power feeding ports for communicating the inside of the waveguide with the heating chamber, and a microwave oscillating antenna arranged along the surface of the waveguide facing the segment between the power feeding parts.

In accordance with the present invention, there is provided a microwave heating apparatus which comprises a microwave heating apparatus main body, a heating chamber provided in the microwave heating apparatus main body, a waveguide member connected to a wall of the heating chamber and forming a waveguide having a substantially rectangular body, power feeding ports formed at both end portions in the longitudinal direction of the waveguide, and a microwave oscillating antenna arranged along the surface of the waveguide facing the portion between the power feeding parts.

BRIEF DESCRIPTION OF THE DRAWINGS

In drawings:

FIGS. 11 and 12 diagrams showing comparative data of uneven heating obtained by using microwave heating apparatuses prepared in accordance with the present invention;

DETAILED DESCRIPTION OF PREFERRED EMBODIMENTS

Figure 1:
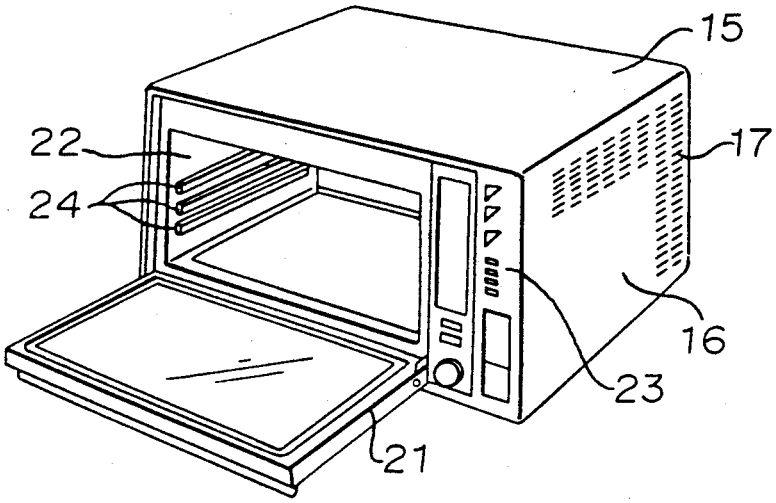
FIG. 1 is a perspective view of an embodiment of the microwave heating apparatus of the present invention.
Figure 2:
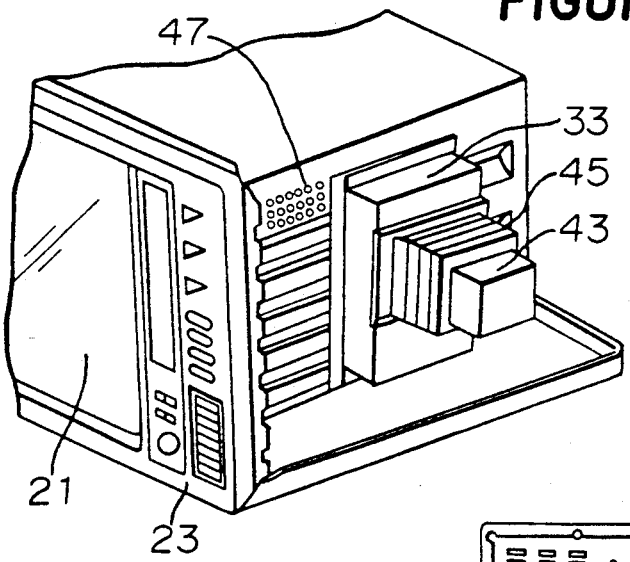
FIG. 2 is a perspective view partly broken of the microwave heating apparatus of the first embodiment.
Figure 3:
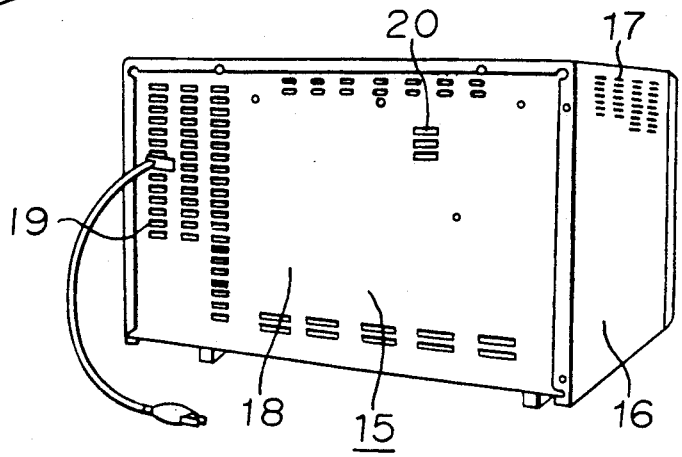
FIG. 3 is a perspective view showing the back of the microwave heating apparatus as shown in FIG. 1.
Figure 4:
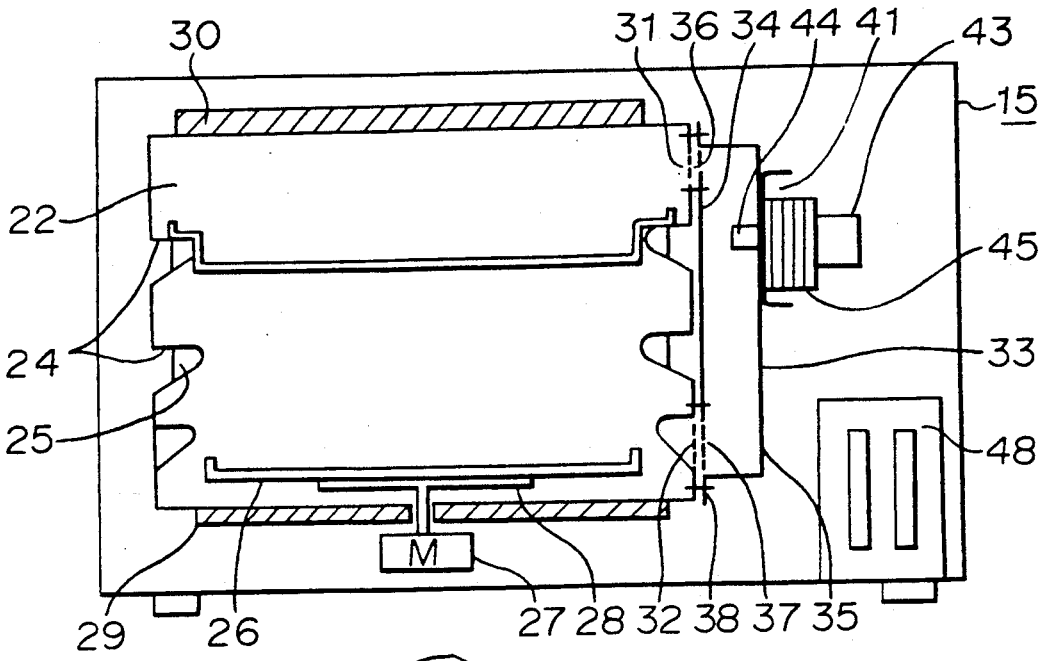
FIG. 4 is a schematic view showing the front part of the microwave heating apparatus as shown in FIG. 1.

Preferred embodiments of the microwave heating apparatus of the present invention will be described with reference to the drawings.

FIGS. 1 through 10 show a first embodiment of the microwave heating apparatus of the present invention. In FIGS. 1 through 10, a reference numeral 15 designates a microwave heating apparatus main body as a main part of an electronic oven, a numeral 16 designates a U-shaped casing having air discharge ports 17 at a side surface, a numeral 18 designates a rear plate in which air intake ports 19 are formed at the right side when viewed from the front of the electronic oven and air discharge ports 20 at the central portion, a numeral 21 designates a vertically opening type door pivotally supported at the lower edge portion of the front part of the electronic oven 15, a numeral 22 designates a heating chamber formed in the electronic oven 15 to have a capacity defined by a width of 343 mm, a depth of 340 mm and a height of 208 mm so that it communicate with the atmosphere by opening the vertically opening door 21, a numeral 23 designates an operating panel provided at the right side of the vertically opening door 21, and a numeral 24 designates dish receiving racks which are attached or formed on both side walls of the heating chamber 1 so as to project therefrom, wherein three rows of the racks are vertically arranged with equal distances at each of the side walls. The front part and the rear part of each of the dish receiving racks are formed in a generally rounded -like shape in vertical cross section. The intermediate portion of each of the dish receiving racks at the upper and middle stages is so formed that the edge portion of the 7 -like portion is vertically cut, and the intermediate portion of the dish receiving racks at the lower stage has no cut portion. The shape of the intermediate portion of the dish receiving racks 24 at the upper and middle stages is called a recess 25.

A numeral 26 designates a turn table to receive thereon a material to be cooked (hereinafter, referred to as a cooking material). The turn table is put on a rotating plate 28 which is placed in the heating chamber 22 and has the lower surface connected to the shaft of a driving motor 27 which is provided at the central portion of the bottom of the microwave heating apparatus main body, i.e. below the heating chamber 22. A numeral 29 designates a lower heater consisting of a mica heater attached to the substantially entire region of the outer bottom surface of the heating chamber 22, and a numeral 30 designates an upper heater consisting of a mica heater placed on the substantially entire surface of the outer top surface of the heating chamber 22. A numeral 31 designates an upper feeding port having a dimension of 15 mm long and 82 mm wide which is formed in the right side wall of the heating chamber 22 and at a position having its center which is 16 mm lower than the upper edge of the heating chamber 22 and 195 mm deeper than the front edge of the heating chamber 22. A numeral 32 designates a lower feeding port having a dimension of 35 mm long and 82 mm wide which is formed in the same right side wall and at a portion having its center which is 173.5 mm lower than the upper edge and 195 mm deeper than the front edge of the heating chamber 22. A numeral 33 designates a waveguide as a waveguide member attached to an outer wall of the heating chamber 22 by spot welding so as to communicate the upper and lower feeding ports 31, 32 with the heating chamber 22. The outer configuration of the waveguide is in a substantially rectangular prism.

Figure 5:
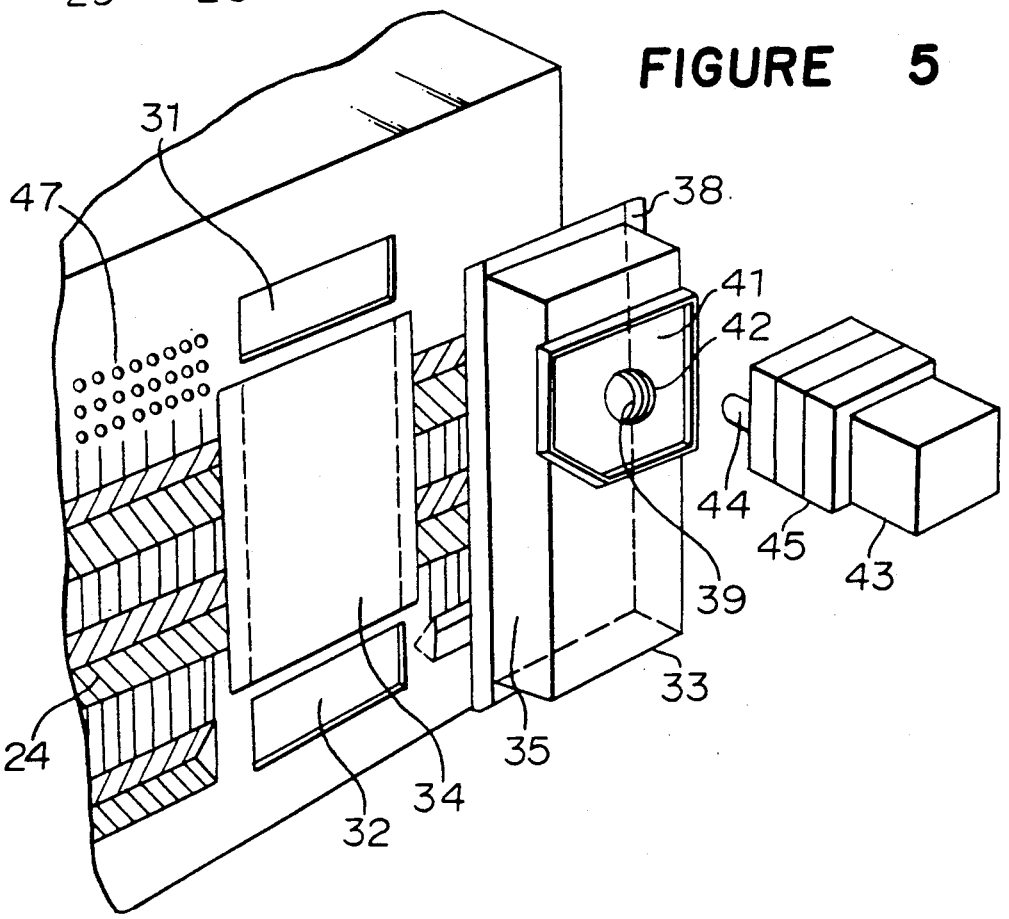
FIG. 5 is a perspective view of a waveguide in a disassembled state, which is used for the microwave heating apparatus as shown in FIG. 1.
Figure 6:
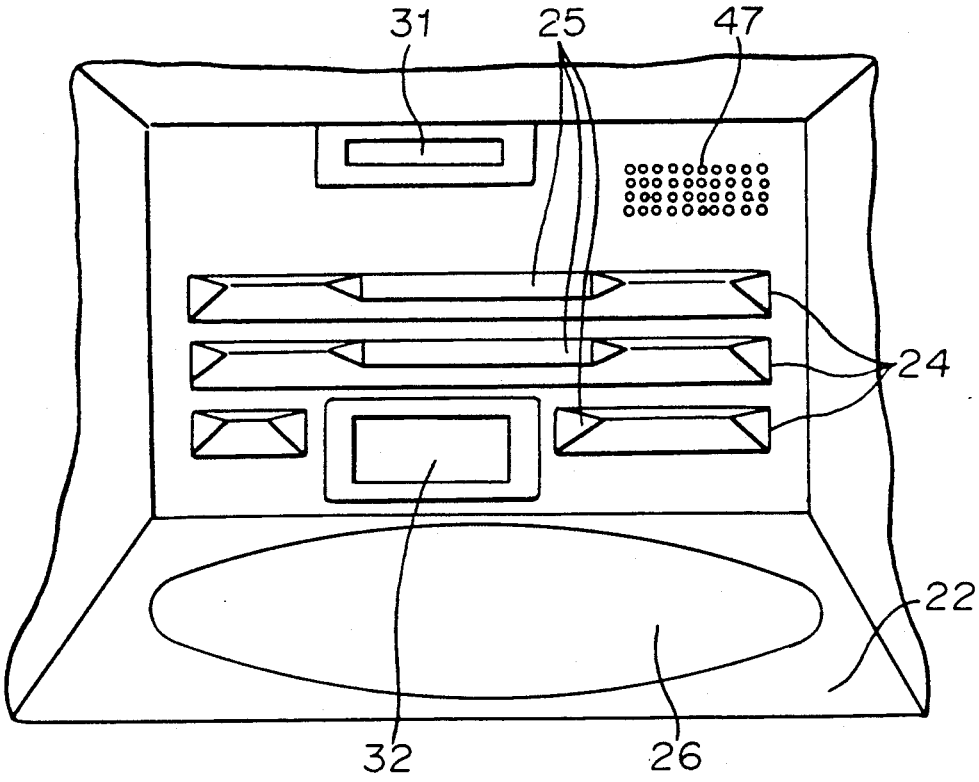
FIG. 6 is an elevation view partly omitted of a heating chamber in the microwave heating apparatus as shown in FIG. 1.

The waveguide 33 is basically constituted by three structural elements as shown in FIG. 5. This will be described in detail. A numeral 34 designates a guide plate having a dimension of 130 mm long, 110 mm wide and 0.6 mm thick which covers an uneven surface formed in the outer side wall of the heating chamber, the uneven surface being resulted from forming the dish receiving racks 24 in the heating chamber 22 at the position between the upper and lower power feeding ports 31, 32. A numeral 35 designates a guide box of a rectangular prism body having an open surface and having a capacity of 180 mm long×80 mm wide×35 mm high. The central portion of the open surface is covered by the guide plate 34 to thereby form an upper opening 36 and a lower opening 37 which respectively face the upper and lower power feeding ports 31, 32. The guide box 35 has a flange 38 of about 10 mm projecting from the outer circumference of the open surface. Both sides of the flange portion are connected to the outer side wall of the heating chamber 22 together with the guide plate 34 in an overlapping state, and the other portion of the flange 38 is directly connected to the outer wall of the heating chamber 22 by spot-welding. Thus, the upper and lower power feeding ports 31, 32 are communicated with each other in the guide box 35 through the upper and lower openings 36, 37 formed in the guide box 15.

A numeral 39 designates a round opening having a diameter of 22 mm whose center is located at a point which is 55 mm lower than the upper surface of the guide box 35 and at the center in the traversing direction of the surface of the guide box 35 which opposes the upper and lower openings 36, 37. An annular raised portion having a width of 3.5 mm and a height of 1.6 mm is formed around the round opening. The center of the round opening 39 is apart from the center of the upper opening 36 by 46.5 mm and is apart from the center of the lower opening 37 by 137.5 mm.

Figure 7:
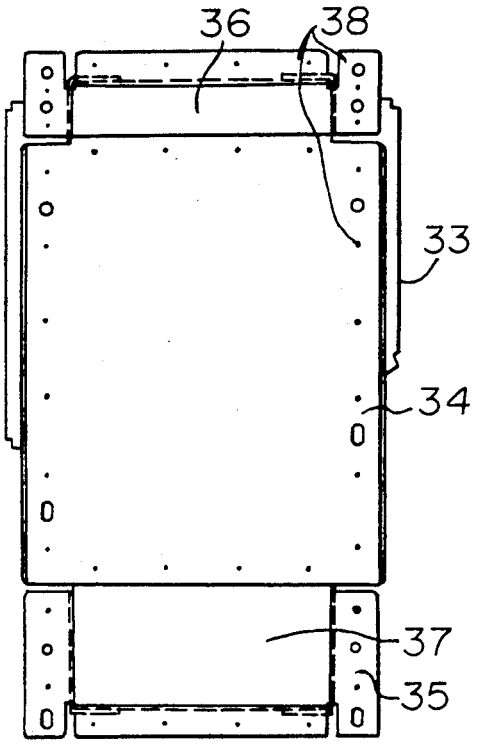
FIG. 7 is a rear view of the waveguide used for the microwave heating apparatus as shown in FIG. 1.
Figure 8:
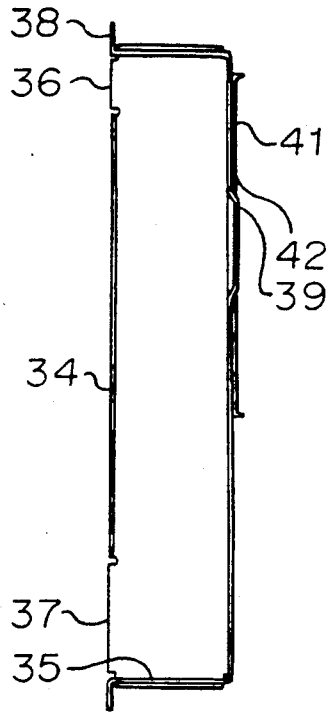
FIG. 8 is a longitudinal cross sectional view of the waveguide as shown in FIG. 7.
Figure 9:
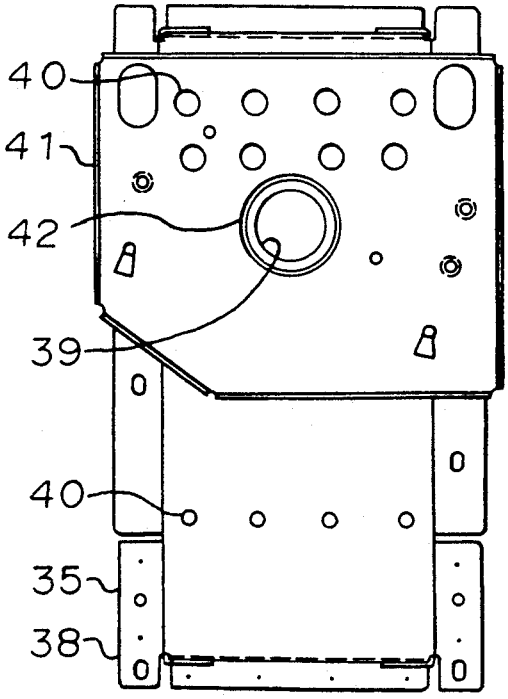
FIG. 9 is a front view of the waveguide as shown in FIG. 7.

As clearly shown in FIGS. 7–9, openings 40 for receiving terminals are formed in the opposing surface of the guide box 35 in order to connect the upper and lower end portions of the guide plate 34 to the outer side wall of the heating chamber 22 by spot-welding. Four openings 40 are arranged in line with intervals of 22 mm at positions 35.5 mm higher than the center of the round opening 39, and four openings are arranged in line with intervals of 22 mm at positions 85.5 mm lower than the round opening 39. A numeral 41 designates a magnetron supporting plate having a dimension of 100 mm long and 122 mm wide which is spot-welded around the round opening 39 of the guide box 35, and has an opening 42 having a diameter of 31 mm which opens facing the round opening 39. The entire circumference of the magnetron supporting plate 41 is bent at a right,. angle in the direction opposite the guide box 35. The right and left side portions of the magnetron supporting plate 41 are separated from the outer surface of the guide box 35. Thus, the waveguide 33 comprises the guide plate 34, the guide box 35 and the magnetron supporting plate 41.

Figure 10:
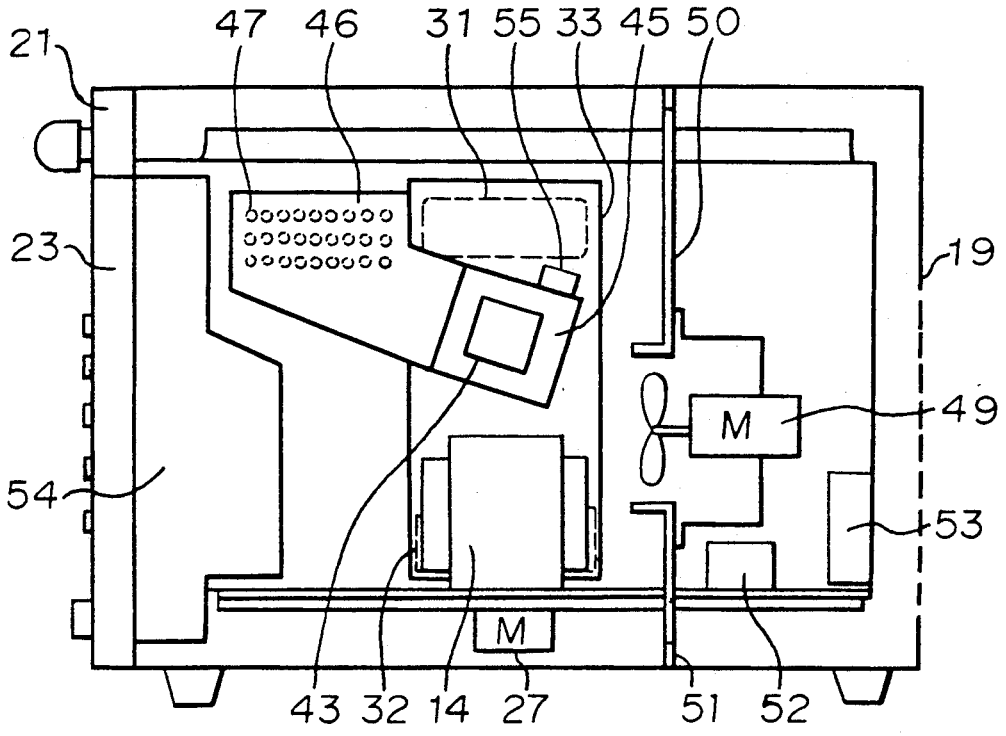
FIG. 10 is a structural diagram showing a side portion of the microwave heating apparatus of the first embodiment.

Description will be made as to peripheral devices for the waveguide 33 with reference to FIG. 10. A numeral 43 designates a magnetron as a microwave oscillating device which is secured to an element attached to the guide box 35 through the magnetron supporting plate 41 by means of three screws and two pawls. Further, an antenna 44 is inserted in the openings 39, 42. A numeral 45 designates a plurality of cooling fins formed on the entire circumference of the middle portion of the magnetron 43. A numeral 46 designates a duct having an end which is opened to the left side surfaces of the cooling fins 45 and the other end which is opened to a plurality of apertures 47 perforated at the upper part of the outer side wall of the heating chamber 22 to face the vertically opening door 21. A numeral 48 designates a high frequency transformer placed just below the magnetron 43. A numeral 49 designate a blower positioned above and behind the magnetron 43. The blower is so supported that the blades of the blower face an opening of a fan fitting plate 50 which is so constructed that round opening is formed in a upright rectangular flat plate. A packing 51 for anti-leakage is bonded to the circumferential surface of the fan fitting plate 50 so as to be in contact with the inner wall of the casing 16 for the electronic oven 15. A numeral 52 designates a high voltage relay located just below the blower 49, a numeral 53 designates a high voltage capacitor located behind the high voltage relay 52, a numeral 54 designates electronic elements comprising a plurality of substrates which are provided behind the operating panel, and a numeral 55 designates a thermostat attached to the magnetron 43.

As described above, since the antenna 44 is positioned between the upper and lower power feeding ports 31, 32, such construction provides no back plunger. It has been a common knowledge that power feeding can not be obtained through the power feeding ports 31, 32 in the above-mentioned construction. The inventors of the present application have, however, studied for a long term and repeated experiments until a unique structure to break through the conventional idea has been adopted. FIGS. 11 and 12 are diagrams showing uneven heating obtained by the experiments.

For a power feeding method A, a microwave heating apparatus having the same construction as described above was used. In a microwave heating apparatus used for a power feeding method B, the size of opening of the upper power feeding port 31 is same as that of the lower power feeding port 32. In a power feeding method C, a microwave heating apparatus having a single power feeding port which is the same as the conventional apparatus was used.

As is clear from the diagrams, uneven heating in the case of the power feeding methods A, B is less than that of the power feeding method C, and oscillation of microwaves was excellent. Thus, the construction of the waveguide 33 in which the waveguide does not project from an end of the heating chamber 22 in an uneven state reduces cost for materials and processes, improves easiness of assembling and services, and reduces the size of the microwave heating apparatus.

Since the waveguide 33 of a substantially rectangular prism is connected to a wall surface of the heating chamber, the wall surface attached with the waveguide 33 can be reinforced due to the fact that the waveguide 33 uniformly faces the wall surface, hence it can uniformly receive an external force, in comparison with the conventional microwave heating apparatus in which an end of the waveguide projects from the wall surface of the microwave heating main body. In particular, a trouble such as dropping of a dish which is caused by the spreading of the distance between a pair of dish receiving racks by the expansion of the heating chamber 22 when an electric oven is used, can be prevented.

An air layer in the waveguide 33 functions as an insulating material against the wall surface to which the waveguide 33 is connected.

In the above-mentioned first embodiment, the microwave heating apparatus is so constructed that the lower power feeding port 32 has a larger opening than the upper power feeding port 31, and the antenna for oscillating microwaves faces to the upper power feeding port 31. However, the position and the shape of the waveguide 33, the positions of the power feeding ports, the surface area and the shape of the opening for the ports, the position of the antenna and so on may be determined as desired depending on the shape and the volume of the heating chamber 22. Thus, the optimum heating can be given to a heating material by changing a quantity of power fed through each of the power feeding ports.

SECOND EMBODIMENT OF THE PRESENT INVENTION

Figure 13:
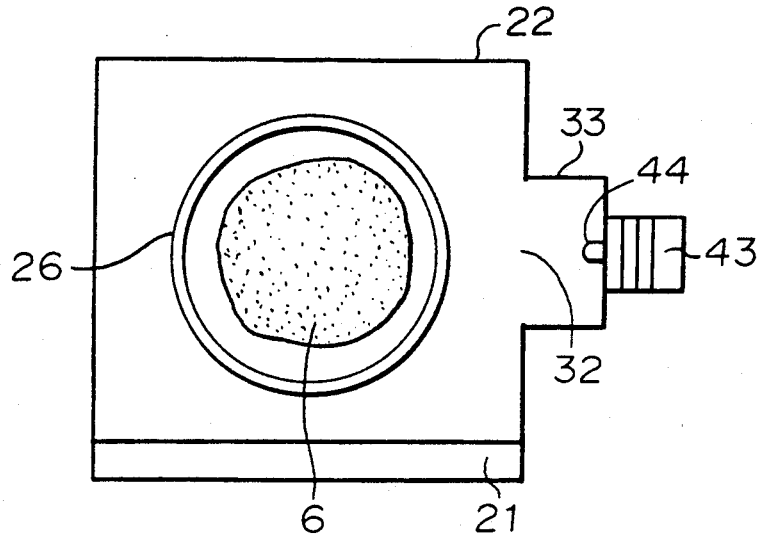
FIGS. 13 and 14 are respectively a plane view and a longitudinal cross-sectional view schematically shown of a second embodiment of the microwave heating apparatus according to the present invention.
Figure 14:
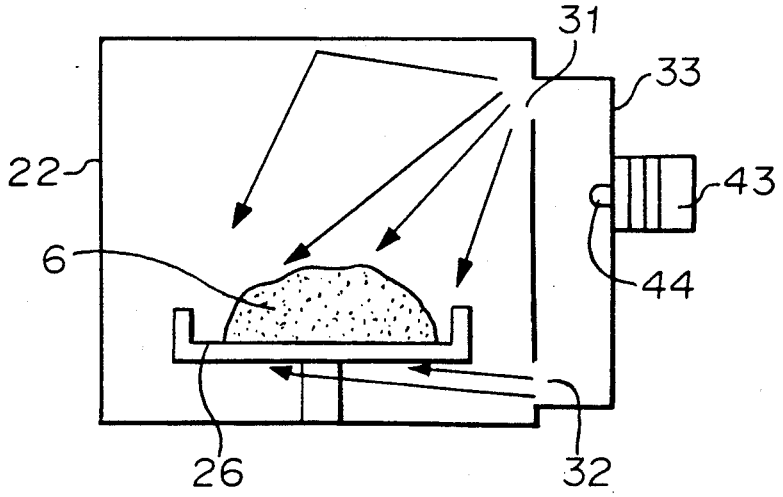

FIGS. 13 and 14 are respectively plane view and a longitudinal cross-sectional view schematically shown of a second embodiment of the microwave heating apparatus. In FIGS. 13 and 14, the same reference numerals as in FIGS. 1 through 10 designate the same or corresponding parts, and therefore, description of these parts is omitted. An upper power feeding port 31 is formed at the upper part of a side wall of the heating chamber 22 and a lower power feeding port 32 is formed at a lower part of it. A waveguide 33 with a magnetron 43 is attached to the outer surface of a side wall of the heating chamber 22 so as to be communicated with the upper and lower power feeding ports 31, 32.

In the second embodiment, the lower power feeding port 32 is provided at a place lower than a material to be heated 6. The dimension in the vertical direction (in the direction of height) of the upper power feeding port 31 is 15 mm and the dimension of the lower power feeding port 32 is 35 mm, which is greater than the upper power feeding port 31.

In the second embodiment having the construction as described above, microwaves are fed in the heating chamber 22 through the upper and lower power feeding ports 31, 32, whereby uneven heating to the material to be heated 6 can be reduced and a time of heating can be shortened. When the lower power feeding port 31 is provided at a lower part of the material 6, the microwaves are supplied to the upper and lower portion of the material 6, whereby a time of heating can be further shortened.

THIRD EMBODIMENT OF THE INVENTION

Figure 15:
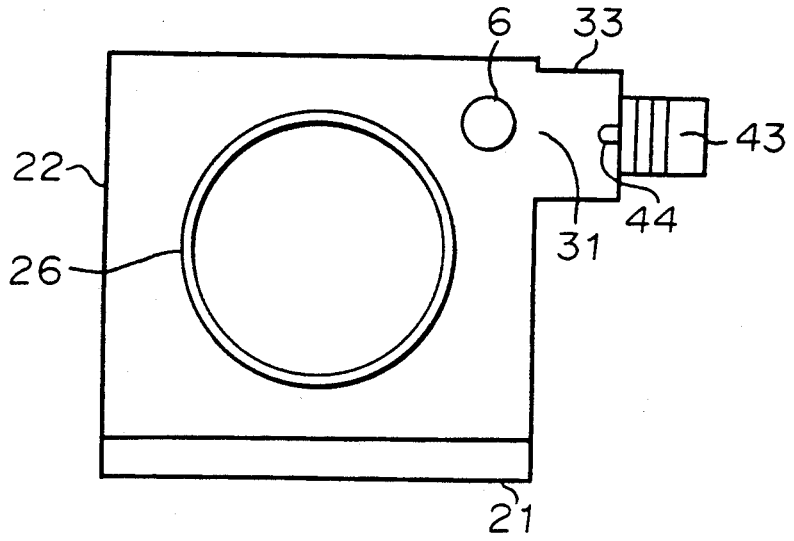
FIGS. 15 and 16 are respectively a plane view and a longitudinal cross-sectional view schematically shown of a third embodiment of the microwave heating apparatus according to the present invention.
Figure 16:
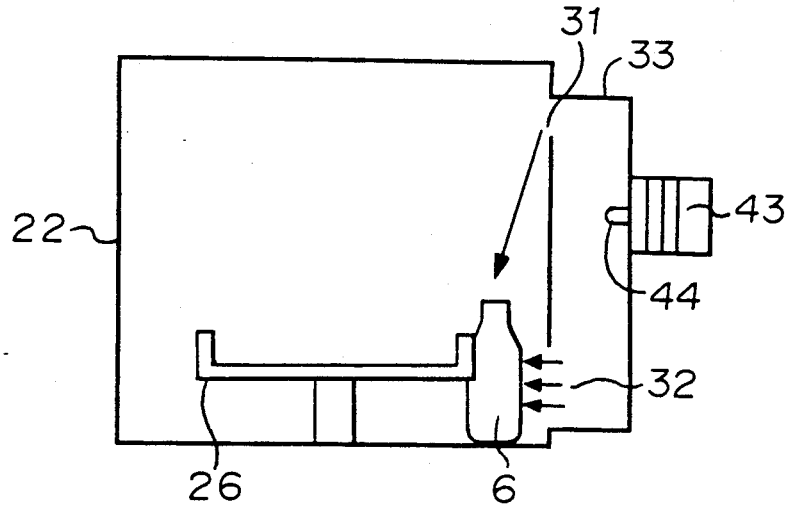

FIGS. 15 and 16 are respectively diagrams showing a third embodiment of the microwave heating apparatus according to the present invention. In the third embodiment, the upper and lower power feeding ports 31, 32 are respectively formed at corner portions (in the direction of depth) of a side wall of the heating chamber 22, and a waveguide 33 with a magnetron 43 is fixed to the corner portion of the outer side of the side wall of the heating chamber 22.

In the third embodiment, a small bottle or a cup containing a water-rich material 6 such as "sake" (Japanese wine), milk or the like can be directly placed at the corner portion of the bottom plate of the heating chamber which does not interfere with the rotation of the turn table 26. Then, the material 6 to be heated can be heated from the upper and side directions to thereby reduce the possibility of uneven heating, and shorten a time of heating. In this case, it is possible to stop the rotation of the turn table 26 if necessary.

FOURTH EMBODIMENT OF THE INVENTION

Figure 17:
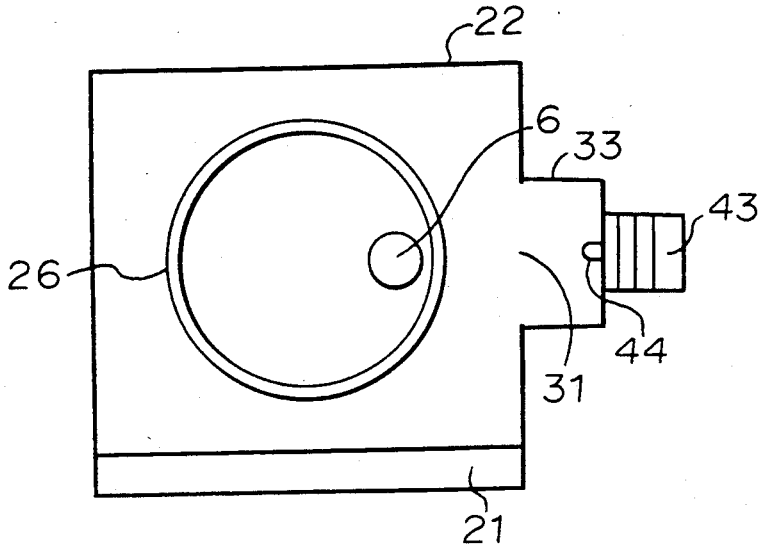
FIG. 17 and 18 are respectively a plane view and a longitudinal cross-sectional view schematically shown of a fourth embodiment of the microwave heating apparatus according to the present invention.
Figure 18:
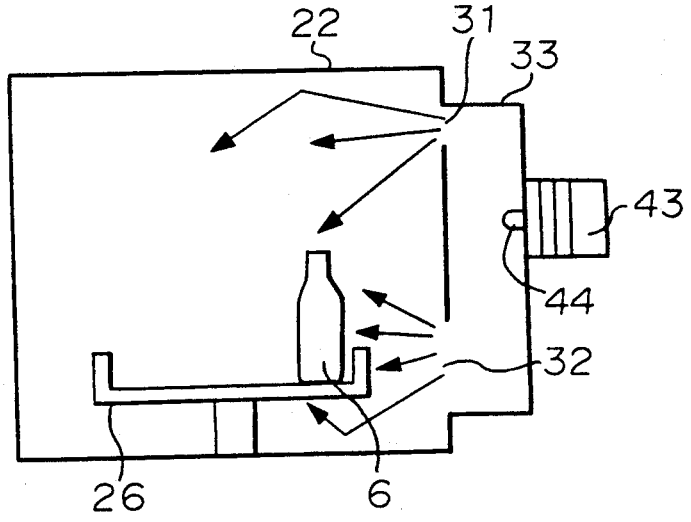

FIGS. 17 and 18 show a fourth embodiment of the microwave heating apparatus of the present invention. In the fourth embodiment, an upper feeding port 31 is formed at the upper portion of a side wall of the heating chamber, and a lower power feeding port 32 is formed in the side wall and near the turn table 26. A waveguide 33 is attached to the outer surface of the side wall of the heating chamber 22.

In the above-mentioned construction, a water-rich material 6 to be heated can be placed on the turn table 26 so as to be close to the lower power feeding port 32. When the turn table 26 is stopped and the material 6 is heated, microwaves are supplied from the upper and side directions to the material 6, whereby a possibility of uneven heating can be reduced and the material can be heated for a short time.

FIFTH EMBODIMENT OF THE INVENTION

Figure 19:
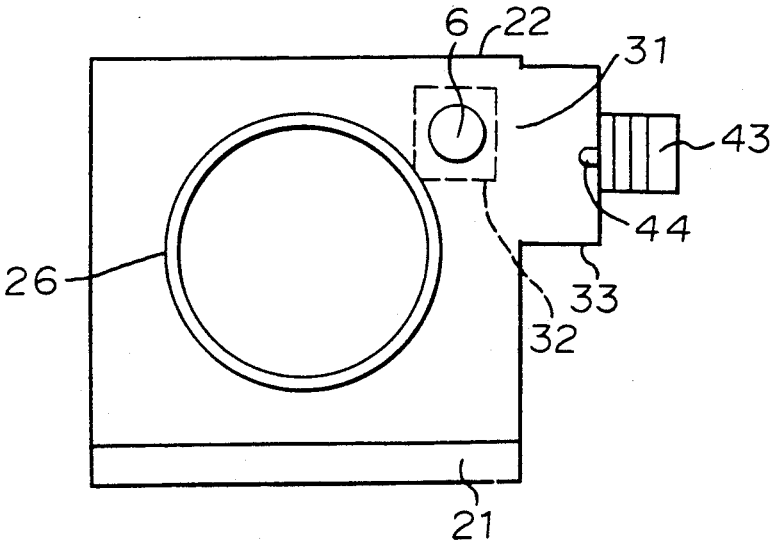
FIGS. 19 and 20 are respectively a plane view and a longitudinal cross-sectional view schematically shown of a fifth embodiment of the microwave heating apparatus according to the present invention.
Figure 20:
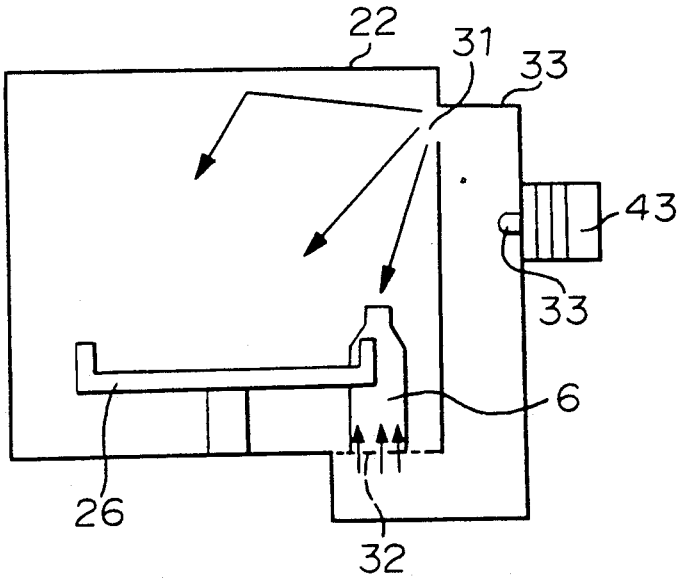

FIGS. 19 and 20 show a fifth embodiment of the present invention. In the fifth embodiment, an upper power feeding port 31 is formed at an upper corner portion in a side wall of the heating chamber 22, and a lower feeding port 32 is formed in the bottom surface of the heating chamber 22. Further, a waveguide 33 is attached to the heating chamber so as to cover the upper and lower power feeding ports 31, 32. With such construction, microwaves are supplied to a water-rich material to be heated 6 from the upper and lower directions when the material 6 is directly put on the lower power feeding port 32. Accordingly, heat is given to the material 6 with a small temperature difference between the upper and lower portions, and the material can be heated for a short time.

ANOTHER EMBODIMENT OF THE PRESENT INVENTION

In the above-mentioned embodiments, the upper power feeding port is formed at the upper portion of a side wall of the heating chamber, and a lower power feeding port is formed at the bottom surface or a lower portion of the side wall of the heating chamber. However, the upper power feeding port may be formed in the ceiling of the heating chamber.

Figure 21:
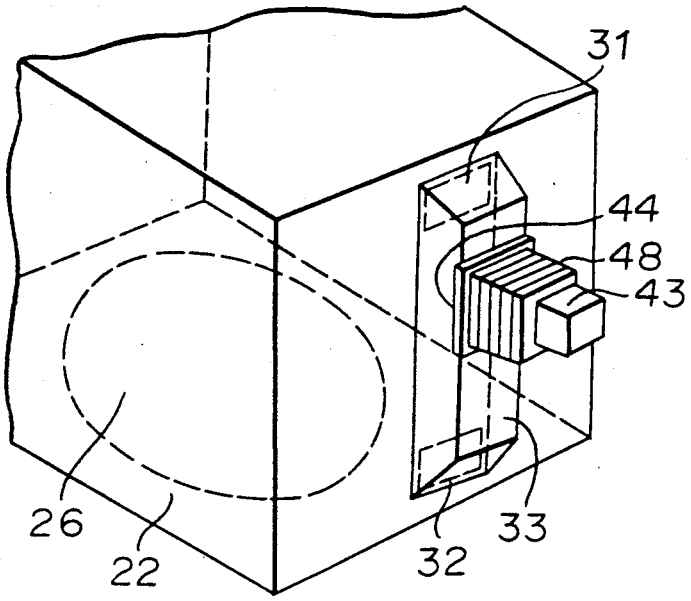
FIGS. 21, 22 and 25 are respectively perspective views showing other embodiments of the microwave heating apparatus according to the present invention.
Figure 22:
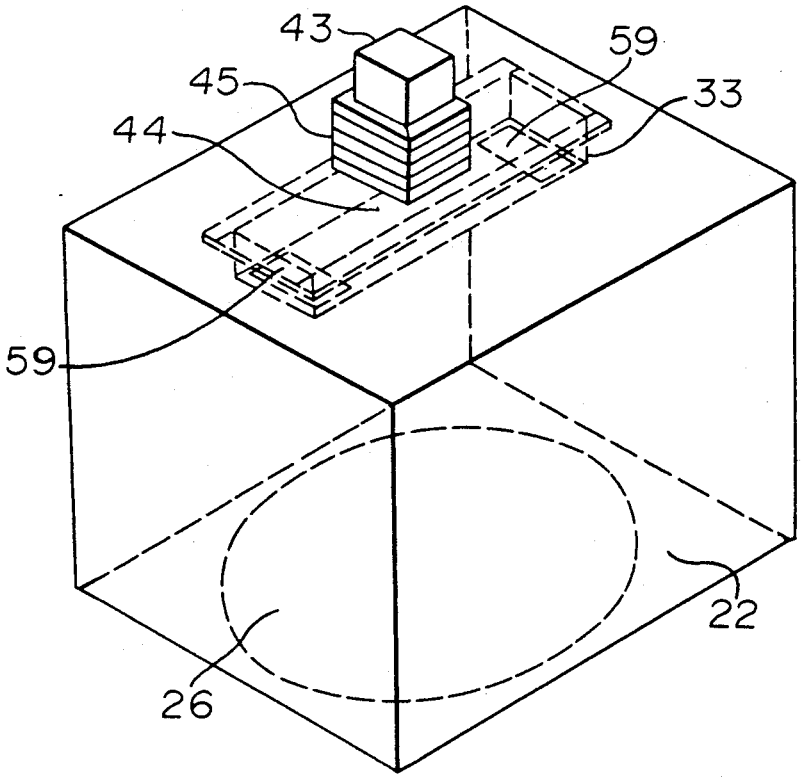
Figure 23:
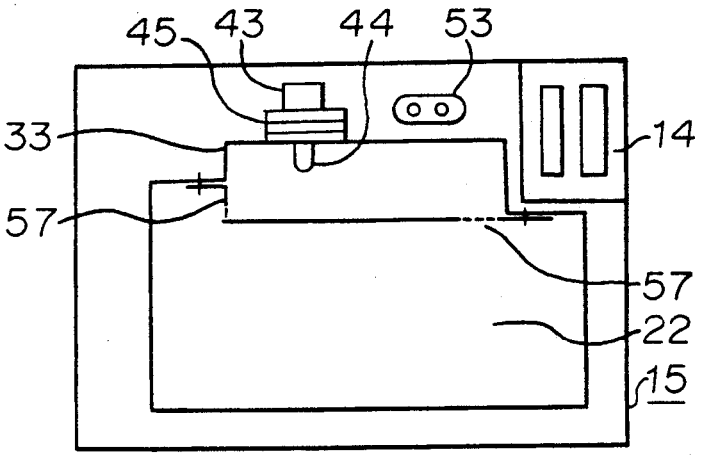
FIGS. 23, 24 and 26 through 30 are respectively front views schematically shown of other embodiments of the microwave heating apparatus of the present invention.

In the first through fifth embodiments, the guide box 35 of the waveguide 33 is attached to the heating chamber 22 so that the upper and lower surfaces of the guide box 35 are respectively perpendicular to the side wall of the heating chamber 22. However, the upper and lower surfaces of the guide box 35 may be inclined so that a skirt portion is formed at the surface for mounting the magnetron 43 of the guide box 35 to the surface which is in contact with the outer surface of the heating chamber 22 as shown in FIG. 21. Thus, by forming tapered portions at the upper and lower surfaces of the guide box 35, the waveguide 33 can be formed by drawing operations. Accordingly, the manufacturing cost can be reduced because only stamping operations are needed for manufacturing the waveguide. The same effect can be obtained by forming the upper and lower surfaces in a spherical form. Further, a tapered portion may be formed at a side surface of the waveguide 33. Accordingly, in the above-mentioned description, the waveguide 33 having a substantially rectangular prism includes embodiments having the above-mentioned tapered surface or spherical surface.

In the first-fifth embodiments, the waveguide 33 is provided at the outer wall of the heating chamber 22. However, it may be formed in or be attached to the inside of the heating chamber 22 as shown in FIGS. 22 through 25. With such construction, it seems that the magnetron 43 is directly attached to the heating chamber 22 in appearance. Accordingly, other structural elements can be arranged at suitable positions, and it is possible to reduce the size of the microwave heating apparatus main body 15.

Figure 24:
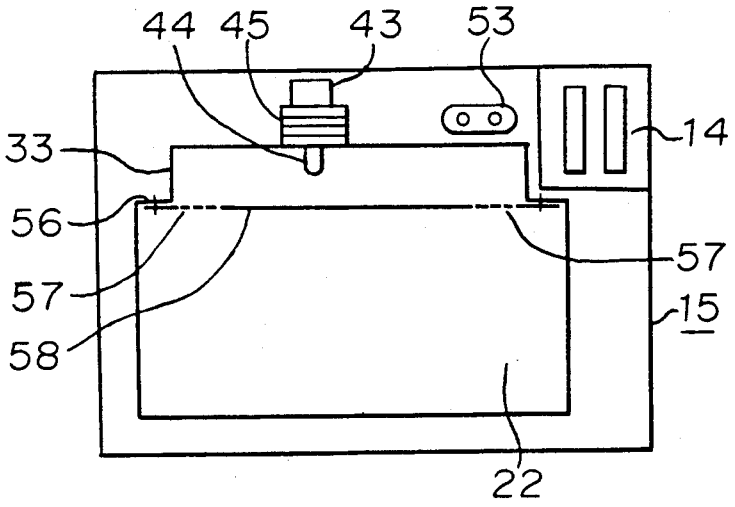

In the waveguide 33 as shown in FIG. 24, step portions 56 are formed at both sides of the upper surface of the heating chamber 22, and a flat plate 58 in which two power feeding ports 57 are formed is mounted on the heating chamber 25 so as to bridge the step portions 56. In the waveguide 33 thus formed, the manufacturing cost can be greatly reduced.

Figure 25:
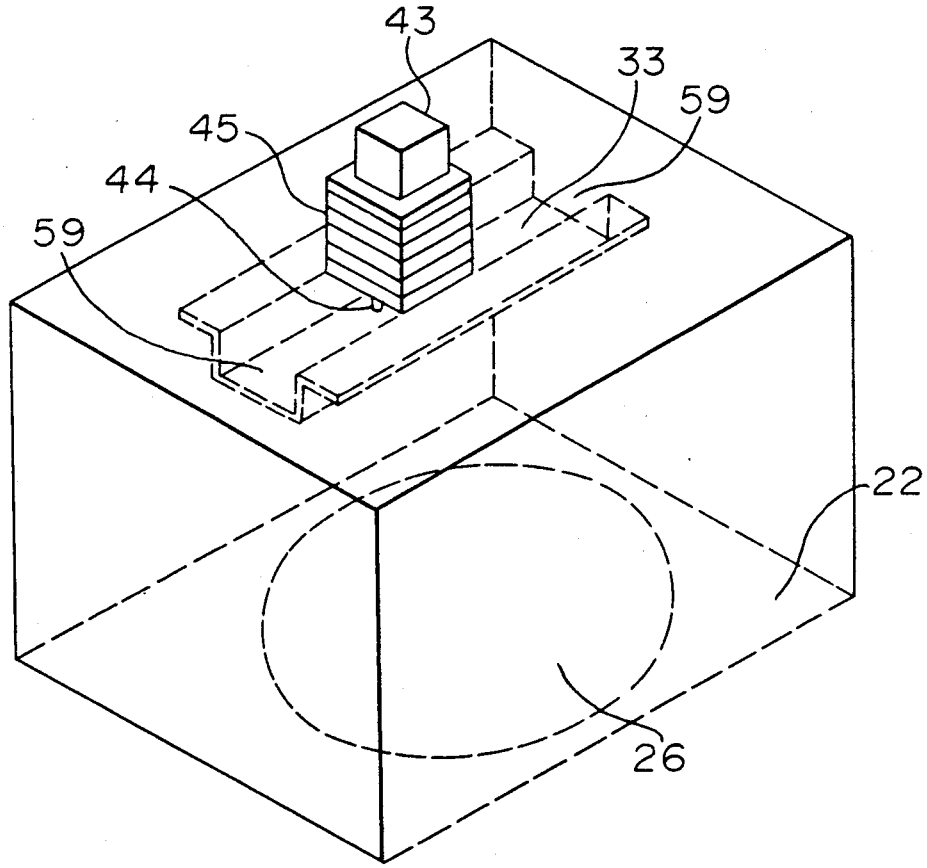

In the waveguide 33 as shown in FIG. 25, the central portion in the shorter side of a rectangular flat plate is stamped to form a recess, and both side portions in the shorter side of the rectangular flat plate are connected to the top surface of the heating chamber 22 by spot-welding, so that power feeding ports 59 are formed at both ends in the longitudinal direction of the heating chamber. Thus formed waveguide 33 reduces the manufacturing cost.

Figure 26:
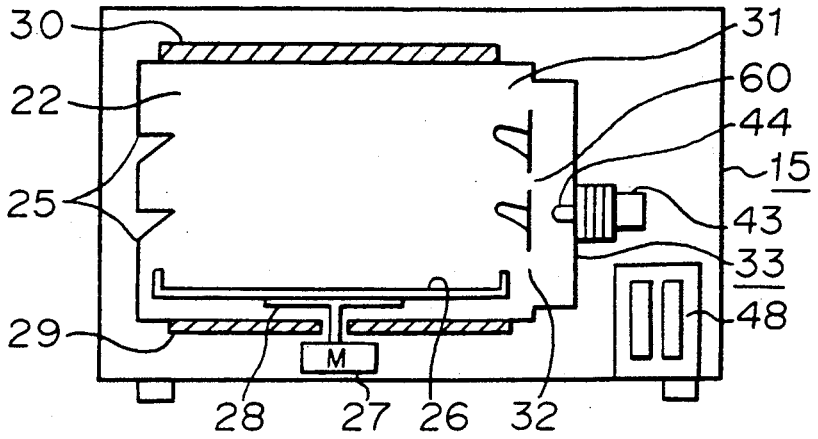

FIG. 26 shows another embodiment of the microwave heating apparatus of the present invention. In this embodiment, an intermediate power feeding port 60 is formed between upper and lower power feeding ports 31, 32. Thus, cooking can be performed while minimizing uneven heating by supplying power from three power feeding ports.

Figure 27:
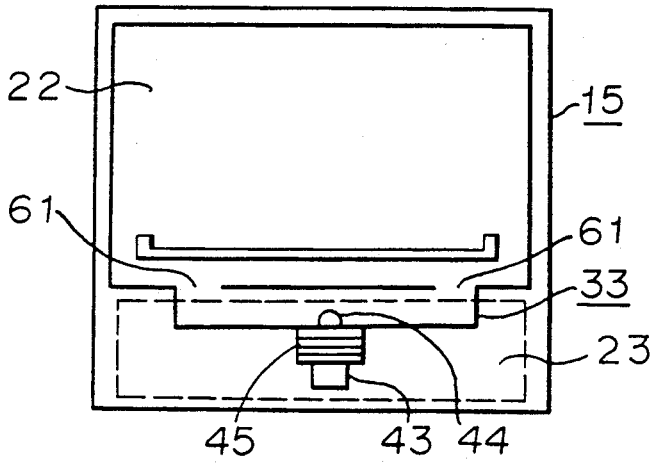
Figure 28:
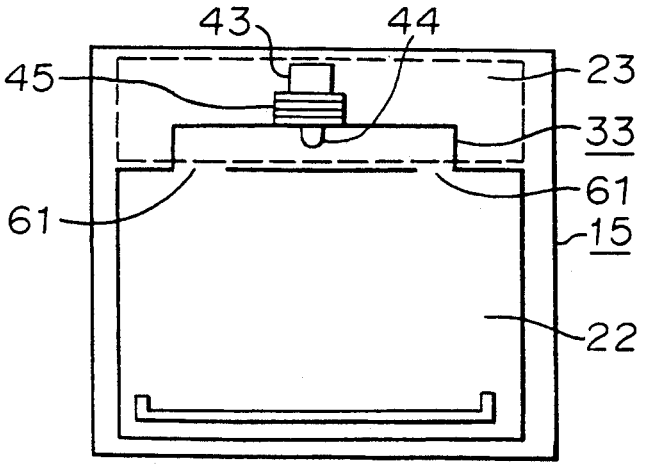

FIGS. 27 and 28 show another embodiment of the microwave heating apparatus of the present invention. In FIGS. 27 and 28, the size of opening of the power feeding ports 61 are the same that of the power feeding port 32, and the antenna of the magnetron 43 is arranged at a position having the same distance from the both power feeding ports 61. In the embodiment as shown in FIGS. 27 and 28, a substantially same amount of radiowaves can be supplied from the power feeding ports 61, so that further uniform cooking can be performed.

In the embodiment as shown in FIG. 27, an operation panel 23 is arranged at a lower portion of the front surface of the heating chamber 22, a waveguide 33 is provided at the outer bottom surface of the heating chamber 22, and a magnetron 43 is arranged below the waveguide 33. Accordingly, the bottom surface of the heating chamber 22 can be strengthened by the reinforcement of the waveguide 33 having a substantially rectangular prism body. This unnecessitates an additional special reinforcing material so that the heating chamber withstands a heavy cooking material.

FIG. 28 shows a modified embodiment of that shown in FIG. 27. In this embodiment, an operation panel 23 is arranged at a upper portion of the front surface of the heating chamber 22. In this case, a waveguide 33 is provided on the outer top surface of the heating chamber 22, and a magnetron 43 is mounted on the waveguide 33, whereby the top plate of the heating chamber 22 is reinforced by the waveguide 43 having a substantially rectangular prism body. Accordingly, a deflection of the heating chamber 22 can be prevented.

Figure 29:
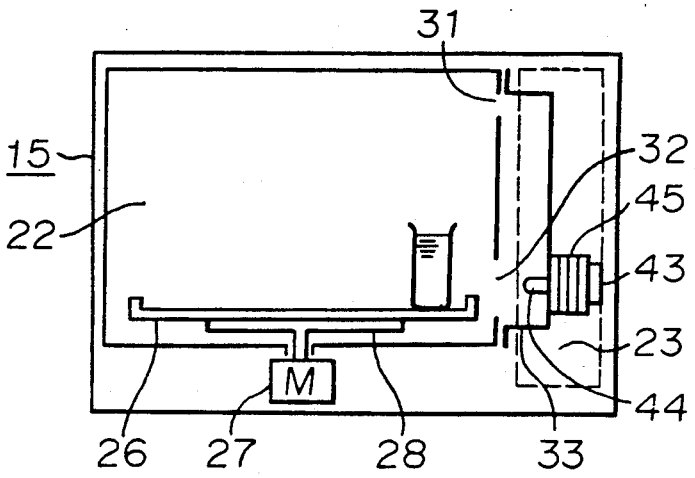
Figure 30:
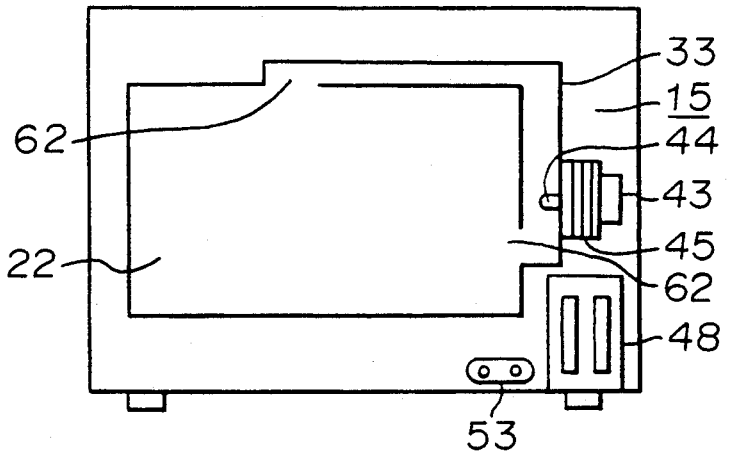
Figure 31:
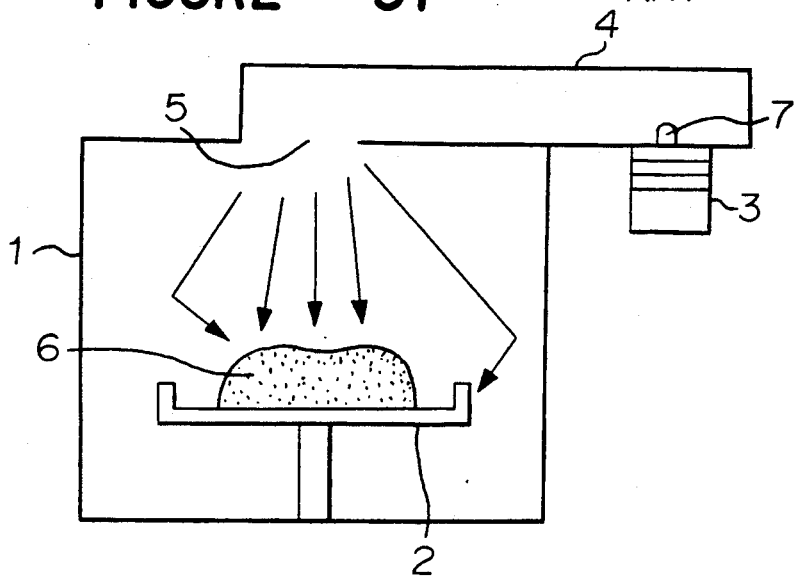
FIGURE 31 PRIOR ART
FIGS. 31 and 32 are respectively longitudinal cross-sectional views showing as forms of model conventional microwave heating apparatuses.
Figure 32:
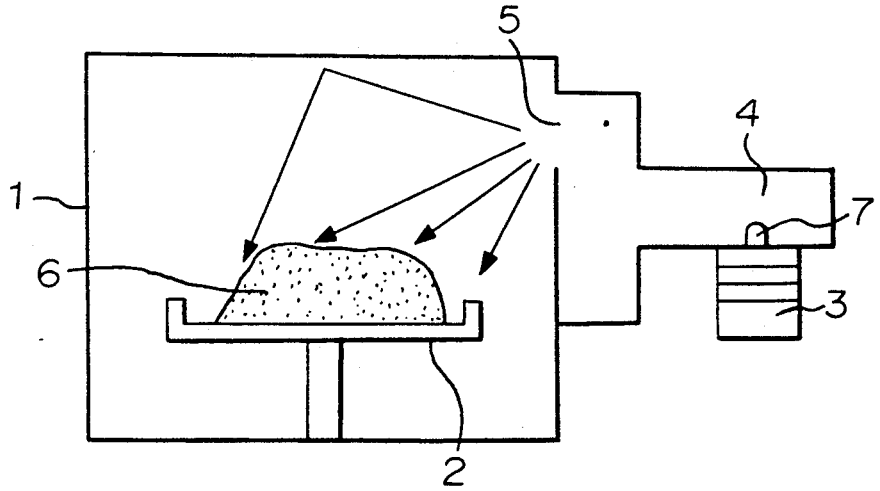
FIGURE 32 PRIOR ART
Figure 33:
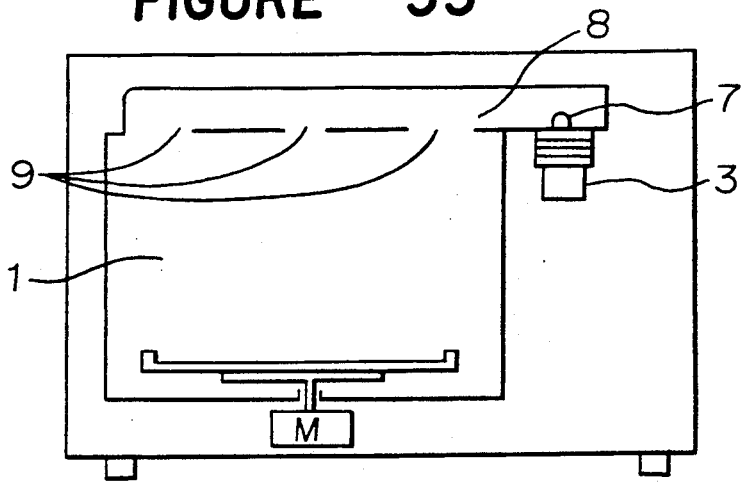
FIGURE 33 PRIOR ART
FIGS. 33 and 34 are respectively front views showing conventional microwave heating apparatuses.
Figure 34:
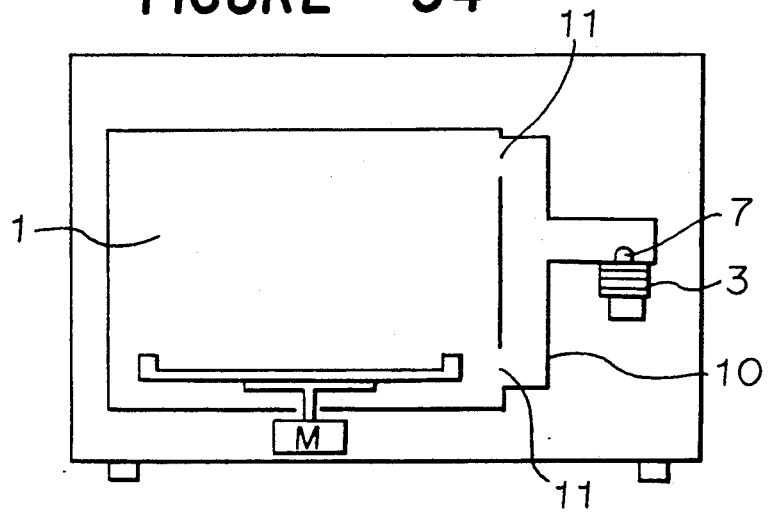
FIGURE 34 PRIOR ART
Figure 35:
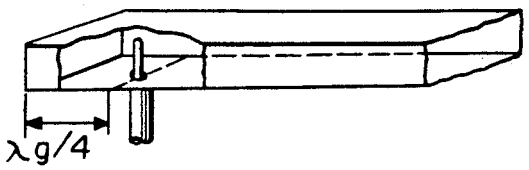
FIGURE 35 PRIOR ART
FIGS. 35 and 36 are respectively a perspective view and a plane view partly broken of a back plunger.
Figure 36:
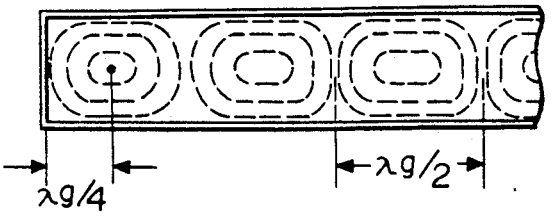
FIGURE 36 PRIOR ART
Figure 37:
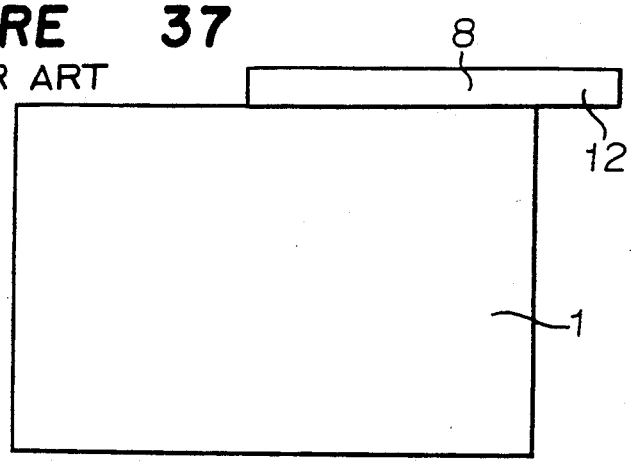
FIGURE 37 PRIOR ART
FIG. 37 and 38 are respectively diagrams showing the structure of conventional waveguides.
Figure 38:
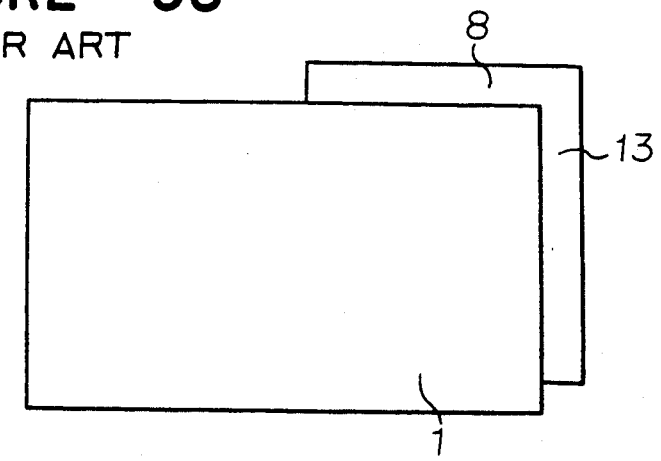
FIGURE 38 PRIOR ART
Figure 39:
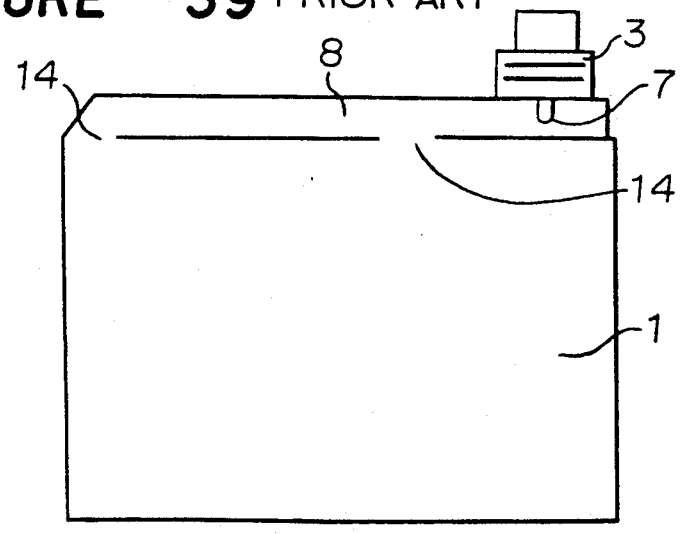
FIGURE 39 PRIOR ART
FIG. 39 is a diagram of a conventional microwave heating apparatus.

Alternatively, the antenna 44 may be positioned to face one of the power feeding ports as shown in FIG. 29.

In order to obtain a sufficient power feeding in a case that any of the power feeding ports is unexpectedly closed, the position and the surface area of opening of the power feeding ports, the position of the antenna 44 and so on can be suitably determined. In this case, it is possible to obtain heat satisfactory even when a power feeding port is closed by a dish or a cup or the like.

Further, the surface area of opening of at least one power feeding port may be varied. Then, a state of power feeding can be changed depending on a material to be cooked, and uneven heating can be reduced.

The same effect can be obtained by providing power feeding ports 62 at the upper and side surfaces of an Llike waveguide 33, and by arranging the antenna 44 in the waveguide so as to face the segment between the power feeding ports 62.

An inverter may be used as a microwave oscillating apparatus for the magnetron.

Thus, in accordance with the first invention, the microwave heating apparatus has the waveguide projecting uniformly on and along a wall or walls of the heating chamber, a plurality of power feeding ports for communicating the waveguide with the heating chamber, and the radiowave oscillating antenna arranged along the surface of the waveguide facing the segment between the power feeding ports. Accordingly, a cooking material can be heated uniformly. Further, the shape of the waveguide can be simple and the manufacturing cost can be reduced.

In accordance with the second invention, the microwave heating apparatus has the waveguide having a substantially rectangular prism body connected to a wall of the heating chamber, power feeding ports formed at both end portions in the longitudinal direction of the waveguide and the microwave oscillating antenna arranged along the waveguide facing the portion between the power feeding ports. Therefore, a material to be heated can be uniformly heated. Further, the shape of the waveguide having the above-mentioned structure can be simple and the manufacturing cost can be greatly reduced. An additional power feeding port may be formed between the two power feeding ports so that microwaves are oscillated in the heating chamber through the three power feeding ports so that a cooking material can be further uniformly heated.

We claim:

1. A power feeding port arrangement for a microwave heating apparatus comprising:

a microwave heating apparatus main body;

a heating chamber provided in the microwave heating apparatus main body and having at least two spaced openings in a wall thereof;

a waveguide including a guide plate at an outside wall of the heating chamber positioned between the at least two openings of the heating chamber and a guide box having a substantially rectangular prism body and an open major side extending between longitudinal ends of the guide box, the guide box enclosing the two spaced openings of the heating chamber and at least a portion of the guide plate positioned therebetween with the open side facing the guide plate to provide a waveguide with at least a pair of power feeding ports; and a microwave oscillating antenna for emitting radiowaves of a given wavelength, the microwave oscillating antenna protruding into the waveguide from a side of the guide box opposite the open side thereof;

wherein the microwave oscillating antenna is spaced from the longitudinal ends of the waveguide by a distance greater than about one quarter of the wavelength of the microwaves emitted thereby;

wherein the microwave oscillating antenna is positioned in the waveguide asymmetrically with respect to the longitudinal ends thereof;

wherein an interior space of the waveguide is substantially a rectangular prism in which only the microwave oscillating antenna is positioned; and wherein one of the pair of power feeding ports have a larger area than an other of the pair of power feeding ports.

2. A power feeding port arrangement for a microwave heating apparatus according to claim 1, wherein the microwave oscillating antenna is positioned further from the power feeding port having the larger area than the other of the pair of power feeding ports.

3. A power feeding port arrangement for a microwave heating apparatus according to claim 1, wherein the heating chamber is provided with a turn table and one of the pair of power feeding ports is positioned adjacent the turn table.

4. A power feeding port arrangement for a microwave heating apparatus according to claim 1, wherein the pair of power feeding ports comprise upper and lower power feeding ports and the lower power feeding port is positioned below a material to be heated in the heating chamber.

5. A power feeding port arrangement for a microwave heating apparatus according to claim 1, wherein the heating chamber has at least one corner and the pair of power feeding ports are positioned at a wall of the heating chamber adjacent the at least one corner.

6. A power feeding port arrangement for a microwave heating apparatus according to claim 1, wherein at least one additional power feeding port is positioned between the pair of power feeding ports.

7. A power feeding port arrangement for a microwave heating apparatus according to claim 1, wherein the side of the guide box opposite the open side is beveled as each end adjacent the longitudinal ends of the waveguide.

8. A power feeding port arrangement for a microwave heating apparatus according to claim 1, wherein the guide plate of the waveguide forms a portion of the wall of the heating chamber having the at least two spaced openings.

9. A power feeding port arrangement for a microwave heating apparatus according to claim 8, wherein the pair of power feeding ports each lie in different planes which are substantially perpendicular to one another.

10. A power feeding port arrangement for a microwave heating apparatus comprising:

a heating chamber having interior walls enclosing a space;

a microwave oscillating antenna for emitting radiowaves of a given wavelength, the microwave oscillating antenna protruding into the heating chamber from one of the interior walls of the heating chamber;

a waveguide comprising a substantially rectangular prism body having an open major side extending between open longitudinal ends thereof, the waveguide being attached to the one of the interior walls of the heating chamber through which the microwave oscillating antenna protrudes with the open longitudinal ends positioned asymmetrically with respect to the microwave oscillating antenna;

wherein the microwave oscillating antenna is spaced from the open longitudinal ends of the waveguide by a distance greater than about one quarter of the wavelength of the microwaves emitted thereby; and wherein an interior space of the waveguide is substantially a rectangular prism in which only the microwave oscillating antenna is positioned.

* * * * *